United States Patent [19]

Cutts

[11] 4,364,157

[45] Dec. 21, 1982

[54] METHOD FOR APPLYING SIZING TO WARP YARNS

[76] Inventor: William H. Cutts, Box 748, Clemson, S.C. 29631

[21] Appl. No.: 208,538

[22] Filed: Nov. 20, 1980

[51] Int. Cl.[3] ..... D06B 1/14; D06B 15/00

[52] U.S. Cl. ..... 28/179; 118/212; 118/234

[58] Field of Search ..... 28/178, 179, 180, 181; 118/212, 234

[56] References Cited

U.S. PATENT DOCUMENTS

| | | | |
|---|---|---|---|
| 1,615,234 | 1/1927 | Ruff, Jr. | 28/178 |
| 1,822,425 | 9/1931 | Sussmuth | 28/178 |
| 2,656,582 | 10/1953 | Freedlander | 28/178 |
| 3,401,670 | 9/1968 | Oxford, Jr. | 118/212 |
| 3,407,784 | 10/1968 | Hitt et al. | 118/234 |
| 3,762,365 | 10/1973 | Herzog | 118/261 X |
| 3,862,475 | 1/1975 | Illman et al. | 28/178 |
| 3,990,132 | 11/1976 | Illman et al. | 28/178 |
| 4,245,583 | 1/1981 | Schollkopf et al. | 118/249 X |

FOREIGN PATENT DOCUMENTS

| | | | |
|---|---|---|---|
| 843938 | 4/1939 | France | 28/178 |
| 176 | of 1853 | United Kingdom | 28/178 |
| 850485 | 10/1960 | United Kingdom | 28/178 |

*Primary Examiner*—Robert Mackey
*Attorney, Agent, or Firm*—Dority & Flint

[57] ABSTRACT

A method and apparatus for applying sizing S to warp yarns W for weaving is disclosed. The method includes applying a concentrated solution having at least twenty percent solids and possibly up to eighty percent by applying the solution to the warps at the nip 22 of a pair of pressure rolls 12 and 14 where the bottom roll 14 is partially immersed in a slasher box and excess size solution is removed by means of a doctor blade 30. The warp yarns W are delivered directly to the nip. The doctor blade 30 is located downstream of nip 22 between the rollers such that there is no rollback of size at the nip and a desired add-on weight of size S is pressed into the yarns W. In a preferred embodiment, the application roller 14 has a relieved pattern surface 40 and the doctor blade 30 wipes the raised portions thereof leaving a metered amount in the relieved areas of the roll for application to the warps. Solution removed by the doctor blade rolls back to the slasher box. Alternately, a concentrated foam sizing composition F may be applied to a bottom roll 42 and removed by a doctor blade 44 to provide a predetermined foam thickness on the bottom roll which is applied to the warps at nip 22.

10 Claims, 8 Drawing Figures

Fig. 7.
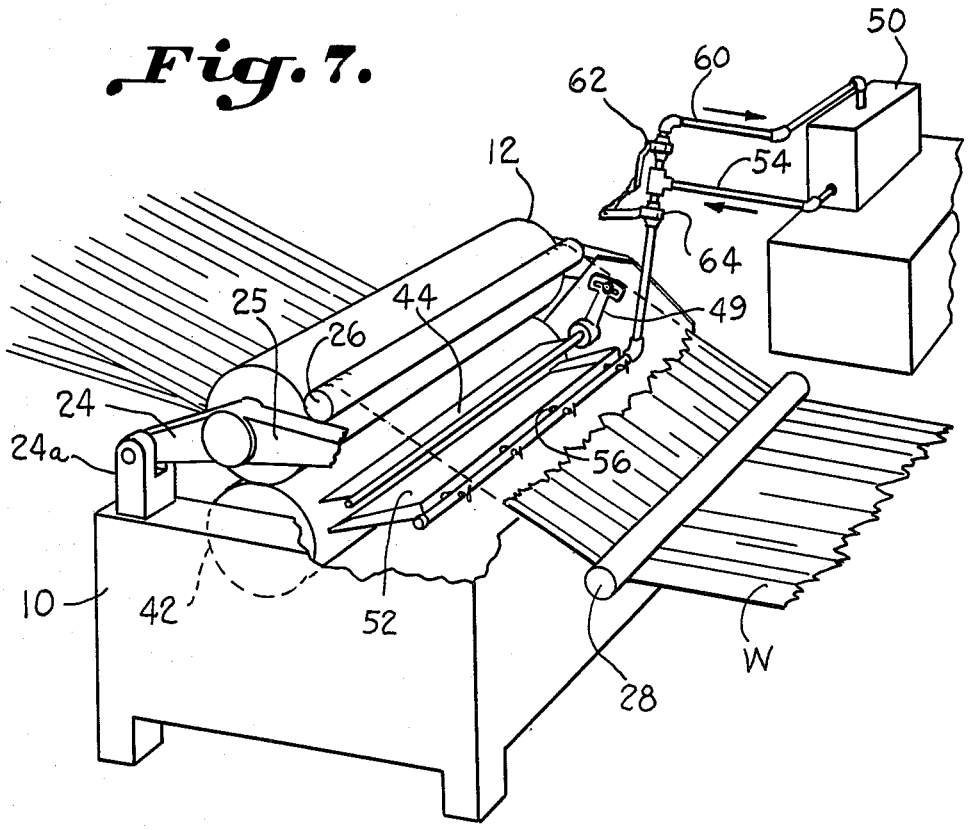
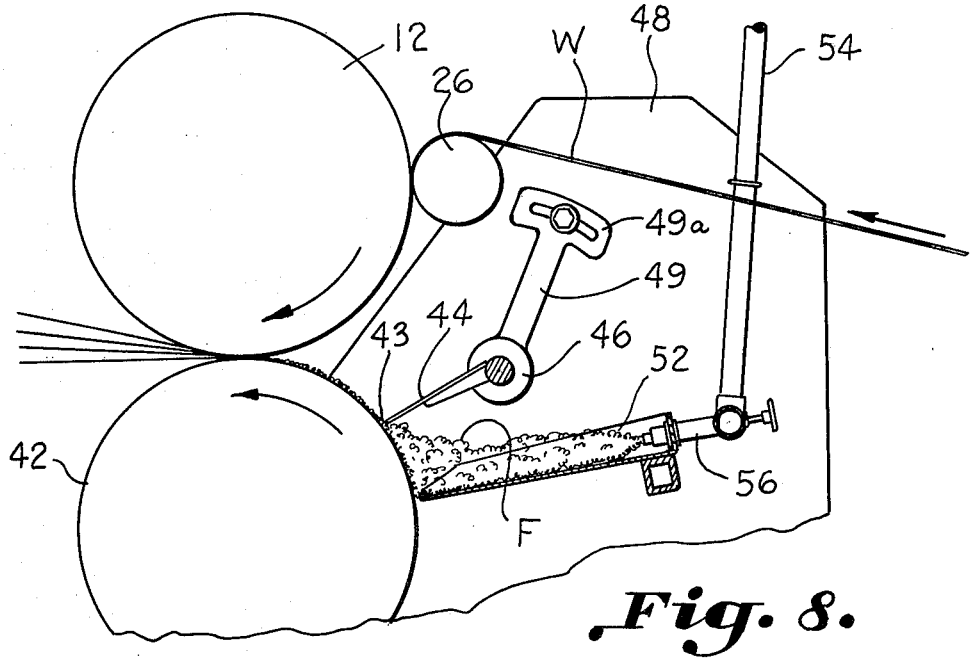
Fig. 8.

METHOD FOR APPLYING SIZING TO WARP YARNS

BACKGROUND OF THE INVENTION

In the process of weaving yarns, warp beams containing the warp yarns are placed on a slasher machine where the yarn is given a protective coat of size to hold the threads together and prevent the threads from being chafed during the weaving process. Water has traditionally been the dissolving medium in which size chemicals are dispersed to aid in uniform application. Typically, a ten percent add-on weight of size is desirable and a solution of ten percent solids (sizing) and ninety percent water has been utilized. However, this requires that nine pounds of water for every one pound of size be squeezed and dried out of the yarns requiring a considerable amount of energy.

In conventional processes, the warps are passed under an immersion roll and totally immersed in the sizing solution in the slasher box. Subsequently, the warps pass between a pair of rolls where one to two thousand pounds of pressure is applied to the warps to press in the size and remove some of the water before drying. Attempts to further minimize drying and energy requirements have included the development of high pressure slasher boxes wherein a more concentrated size solution is applied to the warps and hence less water. Concentrated solutions of up to seventeen percent have been utilized. Pressure rolls operating with pressures of up to twenty thousand pounds are utilized to squeeze out the excess size and water. The normal add-on weight of size is applied to the yarns while less evaporative drying is required due to the presence of less water in the sizing solution and subsequent pickup by the warps. However, considerable amounts of energy is still required in drying.

Drying normally includes passing the warps through a hot air blower box and/or passing the warps over heated dry cans. The warps normally become bonded together to form warp sheets when passing over the heated rolls requiring that the sheets be passed through leasing apparatus to separate the warps for weaving. However, damage to the yarn fibers often results as the warps are torn apart during the leasing process.

Engraved, etched or embossed rolls have been, for example, conventionally used in finishing as metering or applicator rolls and the like, as well as in non-wovens for binder application in the print bonding of fibrous webs.

SUMMARY OF THE INVENTION

Accordingly, an important object of the present invention is to provide apparatus and a method for slashing warps which reduces the energy required for drying and thus the cost of the sizing process.

Another important object of the present invention is to provide a method and apparatus for more effectively sizing warp yarns by which the weaving process is improved even at lower percentages of size add-on weight.

Another important object of the present invention is to provide a method and apparatus for applying a metered amount of a concentrated size material to warp yarns on a slasher to add a desired weight of size to the yarns with a lower percentage of water in the sizing solution which is picked up by the warps and need be subsequently evaporated.

Yet another important object of the present invention is the provision of a method and apparatus for sizing warp yarns which only require a hot air dryer for drying the warps eliminating the use of dryer cans or rolls and reducing the forming of warp sheets which require leasing.

Still another important object of the present invention is to provide a method and apparatus for slashing which minimizes the need for a leasing process and thus reduces damage to the yarn fibers as occurs when torn apart during leasing.

A further object of the invention is to provide apparatus and a method for applying a predetermined amount of size per unit length to warp yarns for weaving thus applying a higher percentage of size to thin spots in the yarn to increase the strength thereof and reduce yarn breakage.

These objectives are accomplished according to the present invention by providing a pair of squeeze rolls having a nip between which the warp yarns are passed and applying a sizing material to the bottom roll in the slasher box. A doctor blade is disposed adjacent the bottom roll and the nip to remove excess size prior to reaching the nip and provide a metered amount of size for application of a desired add-on weight to the warp. The warp yarns are delivered to the nip where the size is pressed into the warps. In a preferred embodiment, the bottom roll is partially immersed in a concentrated sizing solution and includes etched out areas which pick up and contain a metered amount of solution. The doctor blade engages and wipes the surface of the roll to remove excess size. Alternately, a concentrated foam sizing composition may be applied to the bottom roll and all but a film of foam sizing having a predetermined thickness, as required to apply a desired add-on weight, is removed by the doctor blade.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 7 is a perspective view of an alternate embodiment of apparatus and a method for sizing warp yarns according to the present invention; and FIG. 8 is an enlarged schematic view of the method and apparatus of FIG. 7.

DESCRIPTION OF PREFERRED EMBODIMENTS

Figure 1:
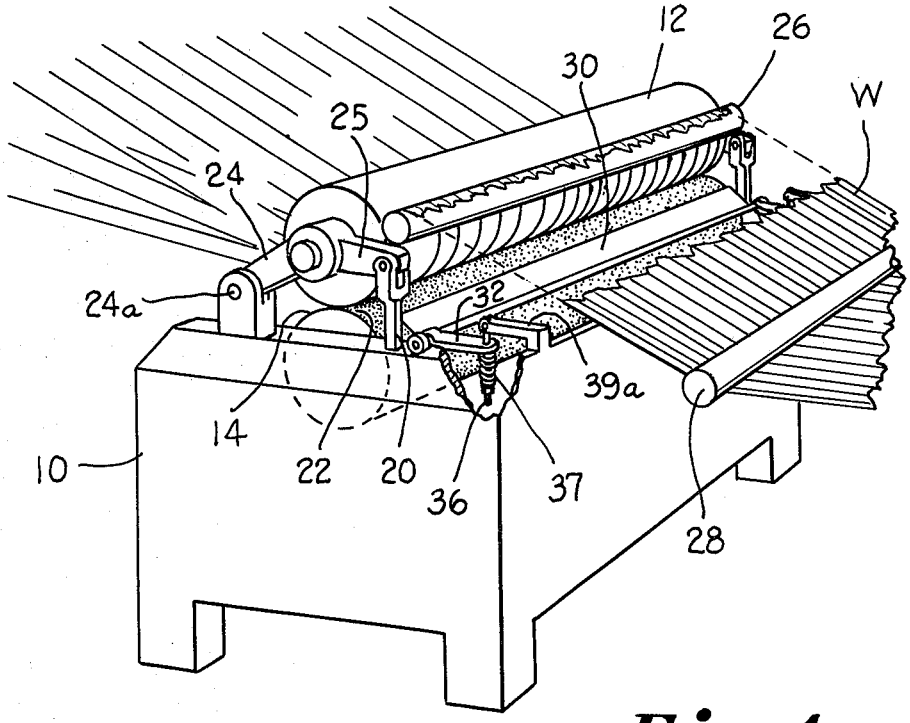
FIG. 1 is a perspective view illustrating a method and apparatus for sizing warp yarns according to the present invention.
Figure 2:
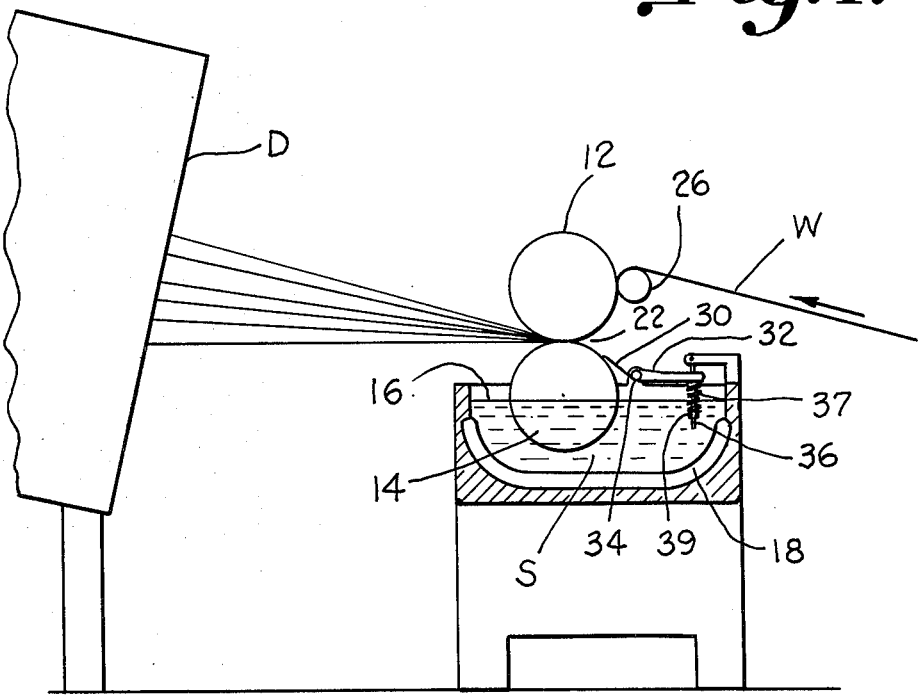
FIG. 2 is a side elevation partially sectioned view illustrating sizing apparatus and a method according to the present invention.
Figure 3:
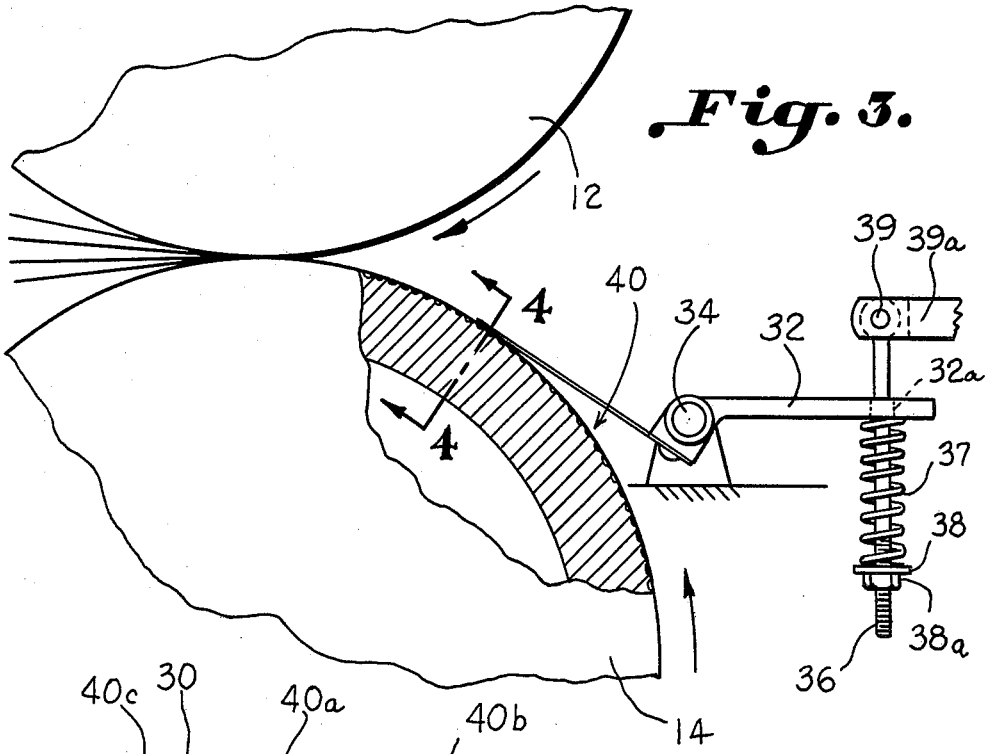
FIG. 3 is an enlarged partially cut-away view illustrating a method and apparatus for applying a metered amount of sizing to warp yarns according to the present invention.
Figure 4:
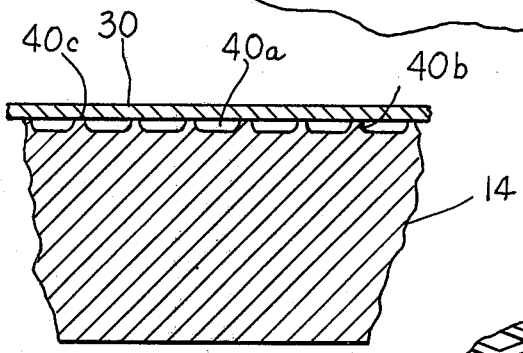
FIG. 4 is a partial sectional view taken along line 4—4 of FIG. 3.
Figure 5:
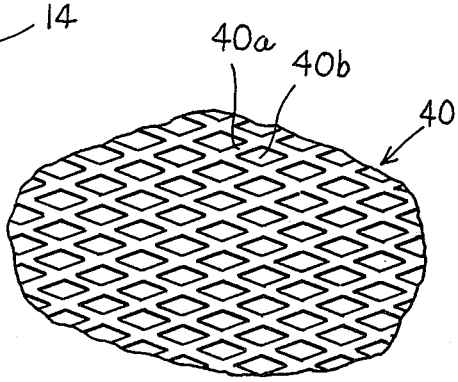
FIG. 5 is an enlarged view of the etched surface of a sizing application roll according to the method and apparatus of the present invention for sizing warps.
Figure 6:
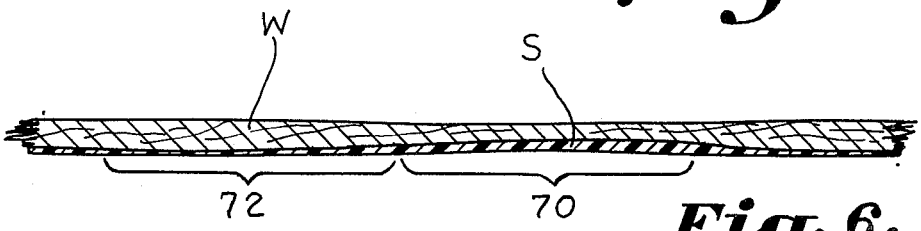
FIG. 6 is an enlarged elevational view illustrating a warp yarn coated with sizing according to the method and apparatus of the present invention.

This invention is directed to a method and apparatus for sizing textile warp yarns which reduces the amount of energy expended in the drying step and provides a warp having superior characteristics and exhibits less defects in the weaving process. Fewer warp breaks occur during the weaving process resulting in less down time for the loom and a better quality woven fabric.

Since the drying and weaving processes are well known in the art, only that part of these processes as is necessary to an understanding of the invention as relates to sizing of the warp yarns is illustrated and disclosed herein.

Referring now to the drawings, apparatus for sizing warp yarns is illustrated as including a slasher box 10 having a pair of elongated rolls 12 and 14 associated therewith which are carried in a superposed relation. The slasher box typically includes a reservoir 16 in which a sizing material S is contained. A hollow jacket 18 is provided through which steam or other heating means may be placed to heat and maintain the sizing material S in a ready liquid form when the size is applied as a sizing solution. Roll 12 is a conventional pressure roll which rotates and exerts pressure on the roll 14. Roll 14 is a driven roll which is rotated by a conventional drive arrangement in the direction illustrated by the arrow. Pressure is applied to the top roll 12 by means of a hydraulic actuator 20 in a conventional manner to apply a desired amount of pressure at the nip 22, the line of contact between the rolls across the length thereof. A pivot arm 24 and pivot 24*a* support the roll 12 on the slasher box 10. Arm 25 connects roll 12 to hydraulic actuator 20 for exerting pressure. The top roll 12 is preferably a rubber roll and the bottom roll 14 a steel or other suitable metal roll. Rolls 12 and 14 are normally 12 inch diameter rolls approximately 87 inches in length.

A 3 inch diameter guide roll, shown schematically at 26, is carried in any suitable manner adjacent the top roll 12 which guides the warp yarns W coming from the warp beams into contact with the rubber top roll 12 prior to entering the nip 22. An auxiliary feed roll 28 may also be utilized to deliver the warps W to the guide roll 26.

Referring now in more detail to the invention, a doctor blade 30 is illustrated as bearing against the surface of the roll 14. The doctor blade 30 is affixed at the end of an arm 32 which is carried by a pivot 34 on the slasher box. The remote end of arm 32 includes an opening 32*a* through which a rod 36 extends. A spring 37 is carried between a retaining washer 38 and the underside of arm 32. A nut 38*a* is threadably carried on a threaded end of rod 36 and may be adjusted lengthwise on the rod to vary the spring bias against the arm 32 and hence the bias force of blade 30 against the surface of roll 14. The remote end of rod 36 is pivotally carried at 39 by arm 39*a* affixed to the slasher box.

In a preferred form of the invention, the sizing material S is a concentrated sizing solution and the bottom roll 14 is partially immersed in the sizing solution within the slasher box reservoir 16. It is desired that a predetermined thickness of the sizing solution is applied to the roll 14 prior to reaching the nip 22 at which point the sizing is pressed into the warp yarns W. However, it has been found, that it is very difficult to machine the steel roll 14 with the required accuracy so that the doctor blade 30 may be set with a predetermined clearance between the roll 14 and the doctor blade to remove all but the predetermined thickness of sizing from the roll 14. For example, in one application a sizing material thickness of 0.001 inches was to be applied to the roll 14 which requires machining tolerances difficult to achieve.

According to the present invention, it is preferred that the bottom roll 14 be provided with a surface having a relieved pattern such as an etched surface 40 which includes etched out portions 40*a* and raised portions 40*b*. The sizing solution is picked up and contained by the etched grooves 40*a* for application to the warps at the nip between the rollers. It is to be understood, of course, that other forms of roll surfaces such as engraved, embossed, fluted or grooved rolls may also be utilized. The construction of the relieved patterned roll may be done in a conventional manner in order to apply the desired amount of sizing.

The doctor blade 30 is brought into contact and wipes with the outermost surface 40*c* of raised portions 40*b* between the etched out areas. In such an application, it has been found that a light Swedish steel blade is preferably utilized. In this manner, it has been found that a desired add-on weight of size may be applied to the warp yarns W at the nip 22 by determining the thickness of the size that is required on the application roll 14 for a solution having a given percent of solids (sizing chemical). By concentrating and metering the sizing solution in this manner, less water is present in the solution requiring less evaporative drying. Normally, passing warps so sized only through a conventional hot air dryer D would be required.

For example, typically 2500 warp ends (yarns) are spread over a 54 inch width and passed side-by-side through the slasher 10 prior to weaving on a loom. A yarn length of 2500 polyester/cotton single ply warp ends (16/1 yarn count, 50/50 blend) weighs approximately 0.186 pounds. A ten percent add-on weight of size would then require application of 0.0186 pounds of sizing material for every yarn length of warp ends being passed through the slasher 10. A gallon of 25 percent solids (sizing chemicals) solution contains 2.08 pounds of solids and since there is 231 cubic inches in a gallon, the weight of 25 percent solids solution per cubic inch would be 0.009 pounds. Therefore, 2 cubic inches of sizing solution would be required to size one yarn length of 2500 warp ends having a 54 inch width passing through the nip 22 of rollers 12 and 14.

A yard length of warps 54 inches wide would cover an area of approximately 1944 square inches. To spread 2 cubic inches of size for a 10 percent add-on weight would require the sizing material to be spread 0.001 inches thick over this area. Therefore, if the sizing solution is metered so that a film thickness of 0.001 inches were applied to roll 14 to be pressed into the warps as they pass through nip 22, a 10 percent add-on weight would be accomplished utilizing 25 percent solids. This would require evaporation of only 3 pounds of water for every 1 pound of solids.

The method would thus include providing a concentrated sizing solution and two contacting elongated rolls 12 and 14 providing nip 22 between which the warps W are passed. Sizing solution is applied to the one roll 14 and all but a predetermined amount (0.001 inches film thickness for 25 percent solids solution) is removed from roll 14 before reaching nip 22. The warps are passed to the nip 22 via guide roll 26 without immersion in the sizing solution. At the nip, the metered amount of sizing is pressed into the warps.

It has been found that pressing in a concentrated amount of sizing results in concentrating the adhesive power of the size on fibers of the individual warps on one side thereof which actually holds the fibers of each individual warp strand together better for weaving purposes. Furthermore by metering and applying the size uniformly per unit length, thin spots 70 in a yarn W receive a larger percentage of size S than thick spot 72 which provides a more uniform strength in the yarn and reduces warp breakage. Since the excess sizing material is returned to the slasher box without any roll back on the warps, as often happens in the conventional processes, any excessive accumulations of size and resulting adhesive globs on the warps are virtually eliminated.

FIG. 7 illustrates an alternate embodiment of the present invention wherein the sizing material applied to an application roll 42 is a foam composition which includes a concentrated percentage of solids or sizing chemicals. The apparatus of FIG. 7 includes the additional structure of a doctor blade 44 which is affixed to block 46 pivotally carried by the side frame 48 of the slasher box. The doctor blade 43 may be set so that a desired clearance space exists between the surface of the roll 42 and the doctor blade 44 so that all but a predetermined thickness of the foam sizing composition is delivered to the nip 22 between the rollers. In this embodiment, roll 42 is a smooth steel roll. Due to the foam composition, the doctor blade may be backed off of the roll 42 a larger distance than with a liquid solution since the foamed composition contains air and is thicker. In an application of a foam composition of 25 percent solids, a clearance space of about 0.01 inches was utilized for a 10 percent add-on weight.

Means for adjusting clearance space 43 is provided by arm 49 having one end fixed to block 46 and a distal end affixed to slotted bracket arm 49*a*. The position of arm 49 may be adjusted and fixed by a set screw to provide a desired clearance space at 43.

Other additional structure required for utilizing the foam composition includes a conventional foaming machine 50 and a foam distribution pan 52 carried adjacent the roll 42. Suitable piping 54 may be utilized to convey the sizing foam F to the pan 52 and distribution nozzles 56 may be utilized to distribute the foam along the length of the pan. Since such a foaming machine normally produces foam constantly, a bypass line 60 is provided so that when the pan is full or a sufficient amount of foam exists in the pan the foam may return to the foaming machine and be refoamed so that it will not deteriorate in the pan. For this purpose, suitable valving at 62 and 64 may be utilized to bypass the foam back to the foamer 50.

It has been found that by passing the warps W over guide roll 26 that the warps contract the rubber roll 12 prior to entering nip 22 which reduces undesirable ribboning effects of the warps when they hit the sizing material. Such tends to preserve the relative spacing of the individual warps upon passing through the nip.

Any suitable sizing may be utilized in either a concentrated solution or foam form such as an acrylic terpolymer or a highly modified polyvinyl alcohol readily available from the Seydel Company of Atlanta, Georgia. A more detailed description of conventional sizing processes and apparatus may be found in *Textile Warp Sizing* by Dr. Paul V. Seydel, published by Long and Clopton, Inc. of Atlanta, Georgia.

While preferred embodiments of the invention has been described using specific terms, such description is for illustrative purposes only, and it is to be understood that changes and variations may be made without departing from the spirit or scope of the following claims.

What I claim is:

1. A method of treating individual textile yarns being supplied from a warp beam which includes the steps of removing the warp yarn ends from the warp beam, subjecting said individual warp yarn ends to a sizing process and drying said warp ends prior to said warp yarns being subjected to a weaving process on a weaving loom, wherein said sizing process comprises:

providing a sizing material for application to individual warp yarn ends coming from said warp beam;

providing a pair of elongated rolls having a nip between which said warp yarn ends are passed;

biasing said rolls against one another at said nip;

applying said sizing material to the surface of one of said rolls;

providing a predetermined metered amount of said sizing material on said one roll at said nip by removing excess sizing material from said one roll prior to reaching said nip and said warp yarn ends; and said predetermined amount of sizing material corresponding to the amount of sizing to be placed on said yarn ends individually generally without any excess;

delivering said warp yarns coming from said warp beam to said nip of said rolls;

pressing said predetermined amount of sizing material into said yarns from one side thereof for sizing said individual warp yarn ends without rollback of sizing material on said warp yarn ends, whereby said sizing remains substantially on the same side of said warp yarn ends that it was applied and the amount of energy required during subsequent drying of said warp yarn ends is reduced.

2. The method of claim 1 including the step of disposing an elongated doctor blade adjacent said one roll for removing excess sizing material from said roll.

3. The method of claim 2 wherein said sizing material includes a sizing solution, said one roll to which said sizing solution is applied being provided by a roll whose surface includes a relieved pattern having raised portions between which relieved portions are formed for receiving sizing solution, and biasing said doctor blade against said one one roll in such a manner as to remove any sizing solution from the surface of said raised portions thereof.

4. The method of claim 3 wherein said relieved pattern is provided by an etched surface pattern.

5. The method of claim 2 wherein said sizing material is a foam composition applied to said one roll.

6. The method of claim 5 including disposing said doctor blade adjacent said one roll with a close clearance therebetween sufficient to remove all but a film of a desired thickness of said foam for application at said nip to said warps.

7. The method of claim 5 wherein said foam composition is a concentrated composition of about twenty percent solids.

8. The method of claim 1 including providing a concentrated solution of said sizing material, substantially all of said predetermined amount of said sizing solution being pressed into said warp yarn at said nip without any significant roll back of said sizing solution from said nip, and said concentrated sizing solution reducing the percent liquid in said solution thereby reducing the amount of evaporative drying required.

9. The method of claim 1 wherein said sizing material is a concentrated sizing solution with the percent solids ranging from about 20 to 80 percent.

10. The method of claim 1 including disposing a guide roll adjacent the other of said rolls and guiding said warp yarns thereover to contact the surface of said other roll prior to reaching said nip.

* * * * *